US007287658B1

(12) United States Patent
Johnson et al.

(10) Patent No.: US 7,287,658 B1
(45) Date of Patent: Oct. 30, 2007

(54) CONTAINER HAVING A BASE WITH A CONVEX DOME AND METHOD OF USE

(75) Inventors: Steven M. Johnson, West Covina, CA (US); Joseph J. Bruchman, Mission Viejo, CA (US)

(73) Assignee: Berry Plastics Corporation, Evansville, IN (US)

( * ) Notice: Subject to any disclaimer, the term of this patent is extended or adjusted under 35 U.S.C. 154(b) by 468 days.

(21) Appl. No.: 10/752,647

(22) Filed: Jan. 8, 2004

(51) Int. Cl.
*B65D 1/02* (2006.01)
*B65D 1/42* (2006.01)
*B65D 31/00* (2006.01)

(52) U.S. Cl. ..... 215/373; 215/384; 220/606; 220/608; 220/609; 141/4

(58) Field of Classification Search ..... 215/373.374, 215/384; 220/606, 608, 609, 771; D9/453–457, D9/516–531; 141/4, 5
See application file for complete search history.

(56) References Cited

U.S. PATENT DOCUMENTS 3,722,726 A * 3/1973 Carmichael et al. ..... 215/373
3,870,181 A * 3/1975 Sincock ..... 215/373
4,342,398 A * 8/1982 Chang ..... 215/373
4,381,061 A * 4/1983 Cerny et al. ..... 220/62.11
5,005,716 A * 4/1991 Eberle ..... 215/373
5,217,737 A * 6/1993 Gygax et al. ..... 426/111
5,234,126 A * 8/1993 Jonas et al. ..... 220/609
5,763,030 A * 6/1998 Matsui ..... 428/35.7
6,176,382 B1 * 1/2001 Bazlur Rashid ..... 215/373
6,277,321 B1 * 8/2001 Vailliencourt et al. ..... 264/529
6,439,413 B1 * 8/2002 Prevot et al. ..... 215/381
6,595,380 B2 * 7/2003 Silvers ..... 215/373
6,942,116 B2 * 9/2005 Lisch et al. ..... 215/373
6,983,858 B2 * 1/2006 Slat et al. ..... 215/373
7,017,763 B2 * 3/2006 Kelley ..... 215/383
2001/0027978 A1 * 10/2001 Finlay et al. ..... 220/669
2002/0153343 A1 * 10/2002 Tobias et al. ..... 215/375
2005/0051509 A1 * 3/2005 Bysick et al. ..... 215/381

* cited by examiner

*Primary Examiner*—Sue A. Weaver
(74) *Attorney, Agent, or Firm*—Barnes & Thornburg LLP

(57) ABSTRACT

A polymeric container for holding a fluid and a gas includes a specially designed base. The base includes an annular outer ridge connected to a convex dome by a flexible annular joint. During a hot fill operation, the structure of the base resists outward deformation. The top is then sealed. During the subsequent cooling of the container, the interior volume decreases forcing the dome upward toward the top of the container thereby reducing the tendency of the sidewall to inwardly collapse. In an embodiment of the invention, the sidewall of the container has a plurality of internally protruding diagonal ridges.

7 Claims, 5 Drawing Sheets

20
22
600
500
501
40
38
24
28
36
32
34
28

20
22
700
600
500
38
40
24
28
36
32
34

CONTAINER HAVING A BASE WITH A CONVEX DOME AND METHOD OF USE

TECHNICAL FIELD

The present invention pertains generally to containers, and more particularly to polymeric containers which are used to hold various fluids.

BACKGROUND OF THE INVENTION

Polymeric containers are used for a variety of purposes. In one use the containers are filled with a hot fluid such as a food product, sealed, and then allowed to cool. During cooling the pressure within the container lowers causing an unwanted inward collapse of the walls of the container.

BRIEF SUMMARY OF THE INVENTION

The present invention is directed to a thin walled polymeric container for holding a fluid and a gas which includes a specially designed base. The base includes an annular outer ridge connected to a convex outwardly protruding dome by a flexible annular joint. During a hot fill operation, the structure of the base resists outward deformation. During the subsequent cooling of the container, in response to the reduced pressure within the container, the dome moves upward toward the top of the container thereby reducing the tendency of the sidewall of the container to collapse. In an embodiment of the invention, the sidewall of the container has a plurality of internally protruding diagonal ridges.

The base resists deforming while being filled with a hot fluid which is in the range of 185° to 212° Fahrenheit, with 195° being typical. The structure of the base allows for inward movement to maintain the stability of the container by preventing deformation of the container from the low pressure which is formed inside the container during cooling. Allowing the base to flex upward inside the container allows the base rather than the walls of the container to deform. With the dome of the base deforming, the contact surface of the container walls remains flat thereby allowing stability while running on the filling line.

In accordance with an embodiment of the invention, a polymeric container for holding a fluid and a gas, comprises:

a top, a base, and an upstanding wall connected therebetween;

the container having a volume;

the base having:

an annular outer ridge which protrudes away from the top, the outer ridge defining a plane upon which the container may rest;

a dome connected to the outer ridge wherein the dome is disposed within the outer ridge, the dome protruding away from the top, the dome having an apex which resides between the top and the plane;

a flexible annular joint connecting the outer ridge and the dome, the annular joint forming an inner ridge which protrudes toward the top;

wherein when (1) the fluid is heated and the heated fluid and the gas are injected into the container, and (2) the top of the container is then sealed, and (3) the fluid and gas within the container are then allowed to cool, during cooling the dome moves toward the top thereby reducing the volume of the container.

In accordance with an aspect of the invention, the upstanding wall includes a substantially cylindrical portion.

A plurality of internally protruding diagonal ridges is disposed upon the cylindrical portion.

In accordance with another aspect of the invention, when the heated fluid and the gas are injected into the container, the base of the container resists movement away from the top.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
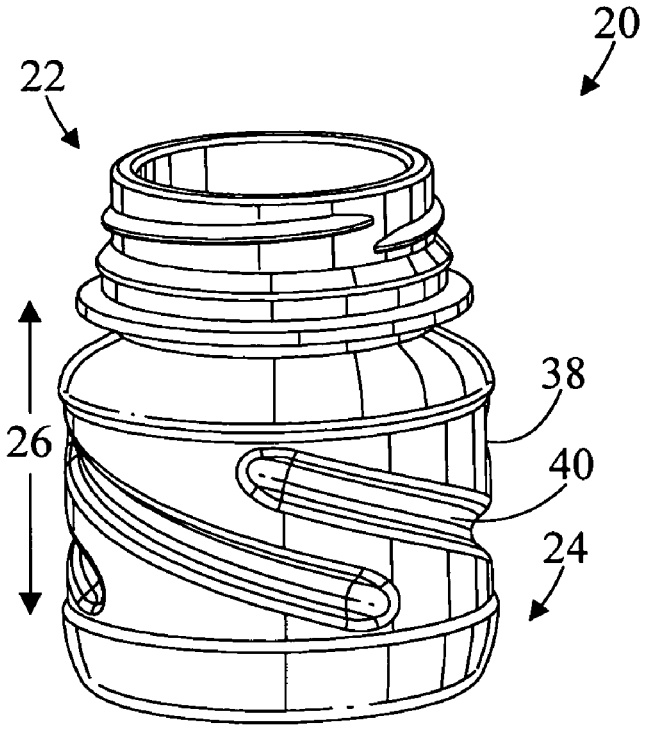
FIG. 1 is a top perspective view of a container in accordance with the present invention.
Figure 2:
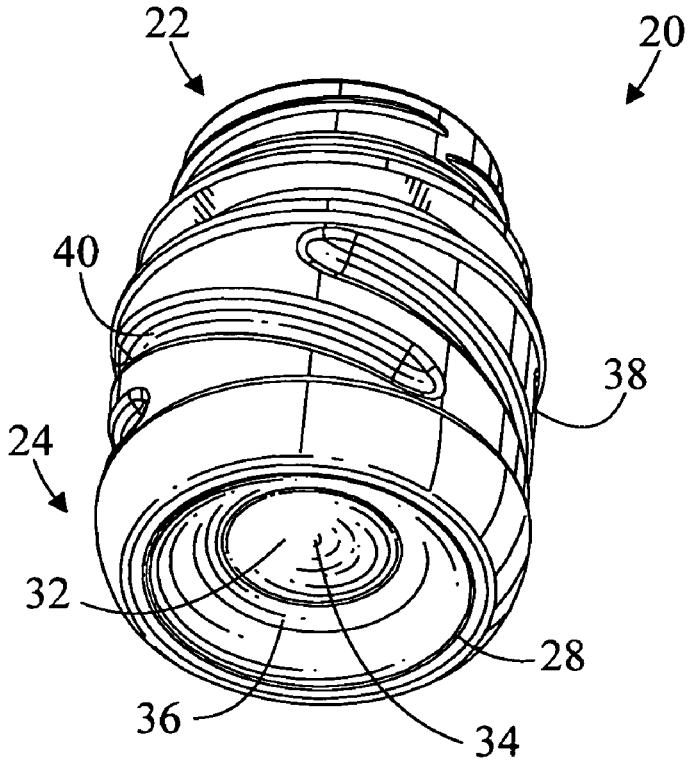
FIG. 2 is a base perspective view of the container.
Figure 3:
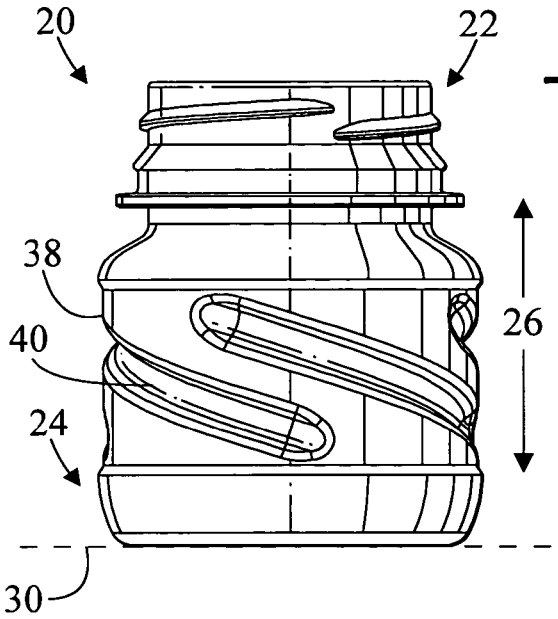
FIG. 3 is a front elevation view of the container.

Referring initially to FIGS. 1-7, there are illustrated top perspective, base perspective, front elevation, side elevation, base plan, top plan, and cross sectional views, respectively, of a polymeric container for holding a fluid and a gas in accordance with the present invention, generally designated as 20. Container 20 includes a top 22, a base 24 and an upstanding wall 26 connected therebetween. Container 20 has an internal volume defined by top 22, base 24 and upstanding wall 26. In the shown embodiment, upstanding wall 26 is cylindrical, however other shapes such as rectangular are also possible. In an embodiment of the invention, container 20 is fabricated from a polymer such as polyethylene terephthalate (PET), but could also be fabricated from other polymers.

Base 24 includes an outer annular ridge 28 which protrudes away from top 22, outer ridge 28 defining a plane 30 (refer to FIG. 7) upon which container 20 may rest. Base 24 also includes a centrally located convex dome (rounded bulge) 32 which is connected to outer ridge 28 so that dome 32 is disposed within outer ridge 28. The dome 32 has a diameter of at least about 25% of the diameter of the outer ridge diameter as shown in, for example, FIGS. 7 and 9. Dome 32 is inverted and protrudes away from top 22. Dome 32 has a central apex 34 which resides between top 22 and plane 30. That is, apex 34 resides above plane 30 when container 20 is placed upon a support surface. As such, dome 32 will not cause instability when the base 24 of container 20 is placed upon a support surface. In an embodiment of the invention, the preform shape of a core 501 of an injecting mold forms dome 32. Then when container 20 is subjected to a hot fill operation (see below and FIGS. 9 and 10), dome 32 tends to assume its original shape as defined by the preform core. Base 24 also includes a flexible annular joint connecting outer ridge 28 and dome 32, the annular joint forming an annular inner ridge 36 which protrudes toward top 22.

Figure 9:
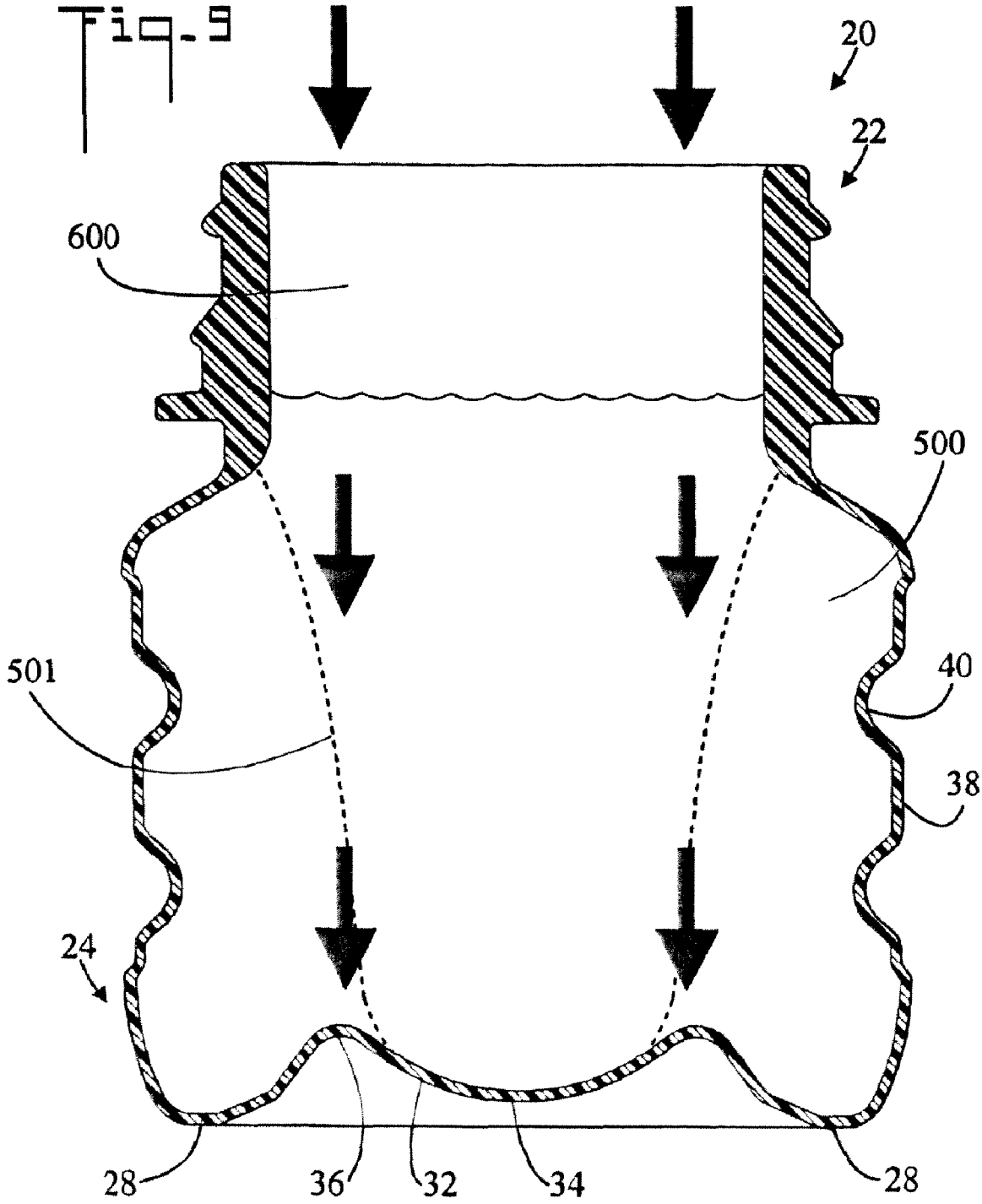
FIG. 9 is an enlarged cross sectional view of the container being filled with a hot fluid and a gas; and, FIG. 10 is an enlarged cross sectional view of the sealed container cooling, showing a dome on the base of the container moving toward the top of the container.
Figure 10:
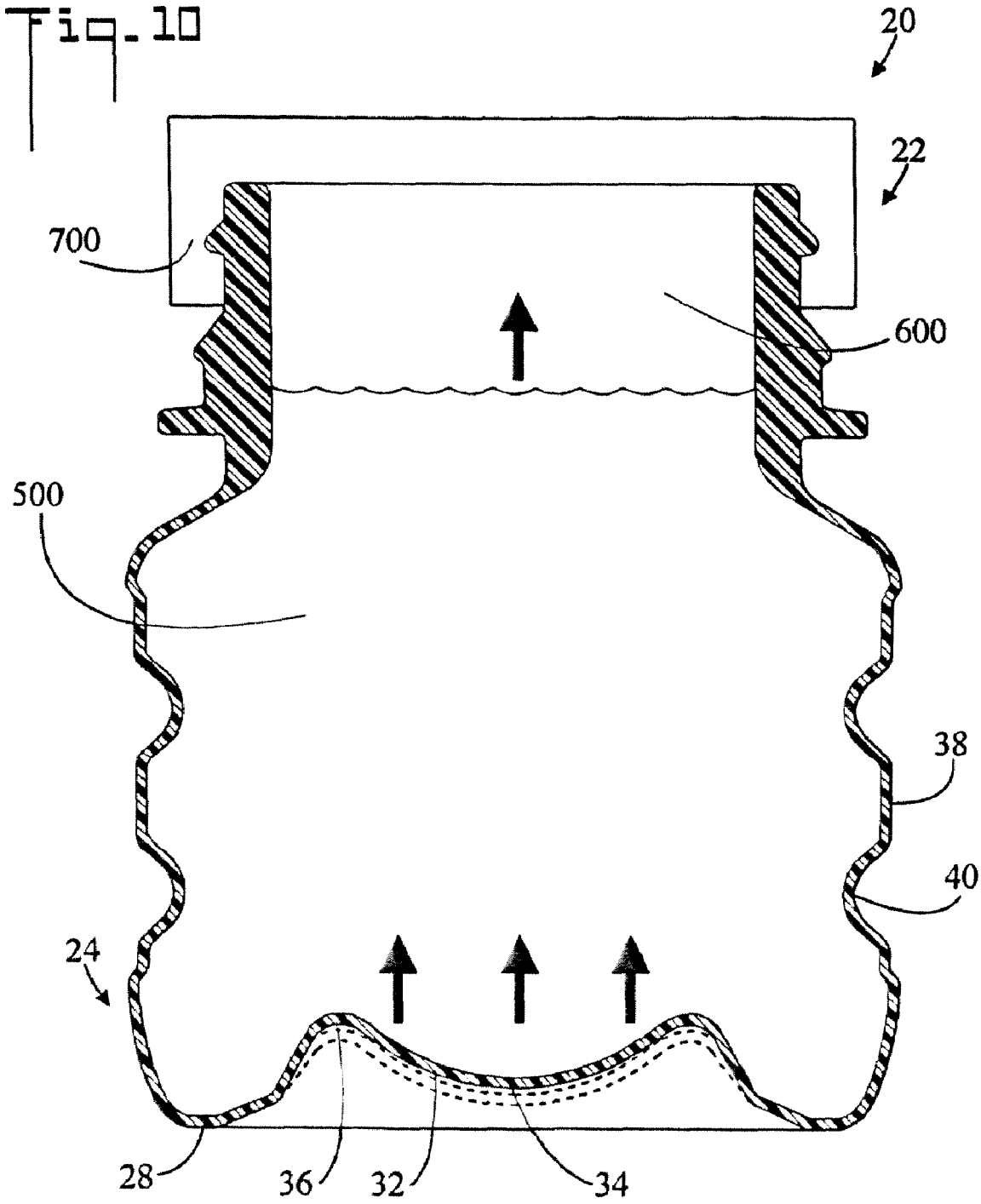

Also referring to FIGS. 9 and 10, when (1) a fluid 500 such as a food product is heated and the heated fluid 500 and a gas 600, typically air, are injected into container 20 in a hot fill operation, and (2) top 22 of container 20 is then sealed such as with a cap 700, and (3) fluid 500 and gas 600 within container 20 are then allowed to cool, during cooling dome 32 moves toward top 22 thereby reducing the volume of container 20. During the hot fill operation, the structure of outer ridge 28, dome 32, and inner ridge 36 combine to cause base 24 to resist deformation (movement) in a direction away from top 22 thereby preventing blowout of the base. During cooling, the annular joint between outer ridge 28 and dome 32 serves as a hinge which allows dome 32 to move upward. The upward movement is caused by the reduction of pressure in gas 600 as container 20 and its fluid 500 and gas 600 contents cool. The upward movement of dome 32 is useful in that it reduces the tendency of the sidewall 26 of container 20 to collapse during cooling. In this fashion, sidewall 26 presents an undeformed surface for the application of labeling materials.

In an embodiment of the invention, upstanding wall 26 includes a substantially cylindrical portion 38. A plurality of internally protruding diagonal ridges 40 such as the four shown is disposed upon cylindrical portion 38. Diagonal ridges 40 serve to strengthen the wall 26 of container 20. Additionally, during cooling after a hot fill, diagonal ridges 40 will not collapse inwardly, but will rather tend to rotate top 22 with respect to base 24 slightly.

Figure 4:
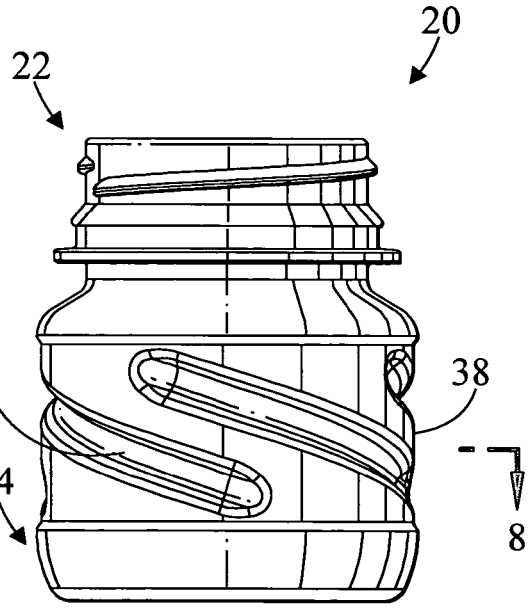
FIG. 4 is a side elevation view of the container.
Figure 5:
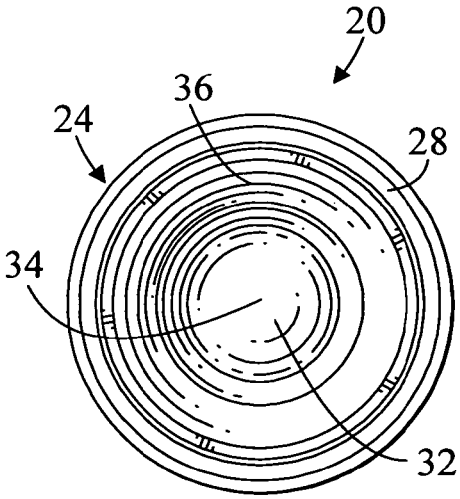
FIG. 5 is a base plan view of the container.
Figure 6:
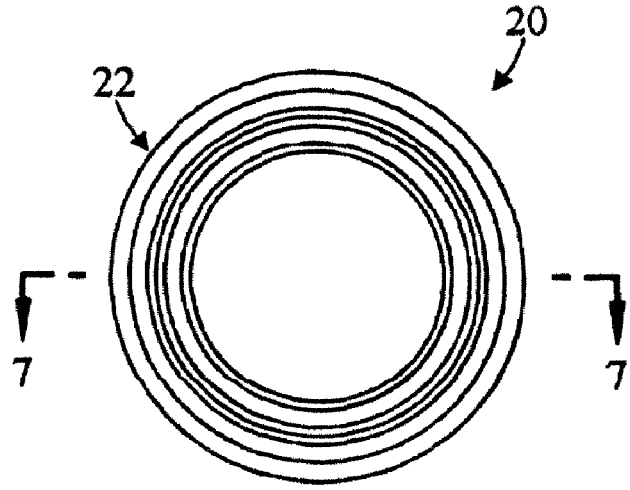
FIG. 6 is a top plan view of the container.
Figure 7:
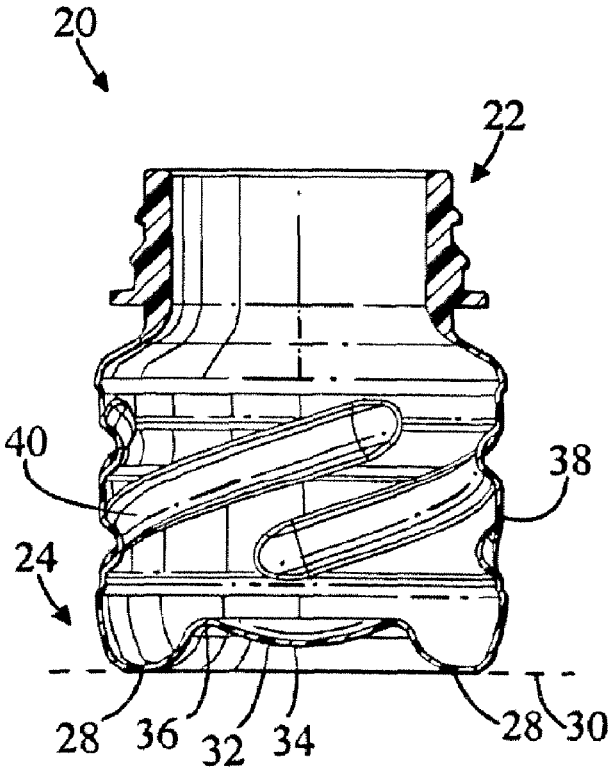
FIG. 7 is a cross sectional view along the line 7-7 of FIG. 6.
Figure 8:
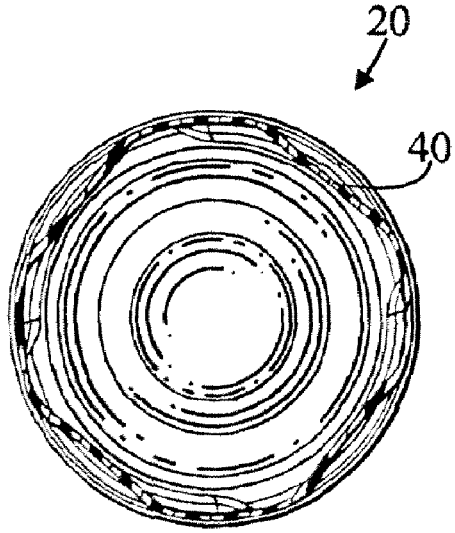
FIG. 8 is a cross sectional view along the line 8-8 of FIG. 4.

FIG. 8 is a cross sectional view along the line 8-8 of FIG. 4 showing internally protruding diagonal ridges 40.

FIG. 9 is an enlarged cross sectional view showing container 20 being filled with a hot fluid 500 and a gas 600. It is noted that during the filling process, base 24 resists movement away from top 22.

FIG. 10 is an enlarged cross sectional view showing sealed container 20 cooling. Dome 32 on the base 24 of container 20 moves toward top 22 of container 20 in response to the reduced volume of gas 600 as container 20 cools. The original position of dome 32 is shown by the dashed line which demonstrates the dome remains protruding away from the top.

In terms of use, a method of filling a container 20, comprises:

(a) providing a polymeric container 20, including:

a top 22, a base 24, and an upstanding wall 26 connected therebetween;

container 20 having a volume;

base 24 having:

an annular outer ridge 28 which protrudes away from top 22, outer ridge 28 defining a plane 30 upon which container 20 may rest;

a dome 32 connected to outer ridge 28 wherein dome 32 is disposed within outer ridge 28, dome 32 protruding away from top 32, dome 32 having an apex 34 which resides between top 22 and plane 30; and, a flexible annular joint connecting outer ridge 38 and dome 32, annular joint forming an annular inner ridge 36 which protrudes toward top 22;

(b) providing a fluid 500 and a gas 600;

(c) heating fluid 500;

(d) injecting heated fluid 500 and gas 600 into container 20;

(e) sealing top 22 of container 20;

(f) allowing fluid 500 and gas 600 within container 20 to cool; and, (g) observing that during (f) dome 32 moves toward top 22 thereby reducing the volume of container 20.

The method further including:

in (a), upstanding wall 26 including a substantially cylindrical portion 38; and, a plurality of internally protruding diagonal ridges 40 disposed upon cylindrical portion 38.

The method further including:

in (d), when heated fluid 500 and gas 600 are injected into container 20, base 24 of container 20 resisting movement away from top 22.

The preferred embodiments of the invention described herein are exemplary and numerous modifications, variations, and rearrangements can be readily envisioned to achieve an equivalent result, all of which are intended to be embraced within the scope of the appended claims.

We claim:

1. A polymeric container for holding a fluid and a gas, comprising:

a top, a base, and an upstanding wall connected therebetween;

said container having a volume;

said base having:

an annular outer ridge which protrudes away from said top, said outer ridge having a diameter and defining a plane upon which said container may rest;

a dome connected to said outer ridge wherein said dome has a diameter of at least about 25% of the diameter of the outer ridge diameter and is disposed within said outer ridge, said dome protruding away from said top, said dome having an apex which resides between said top and said plane; and, a flexible annular joint connecting said outer ridge and said dome, said annular joint forming an inner ridge which protrudes toward said top; and, wherein when (1) the fluid is heated and the heated fluid and the gas are injected into said container, and (2) said top of said container is then sealed, and (3) the fluid and gas within said container are then allowed to cool while the dome remains protruding away from the top, during cooling said dome moves toward said top thereby reducing said volume of said container.

2. The polymeric container according to claim 1, further including:

said upstanding wall including a substantially cylindrical portion; and, a plurality of internally protruding diagonal ridges disposed upon said cylindrical portion.

3. The polymeric container according to claim 1, further including:

when the heated fluid and the gas are injected into said container, said base of said container resisting movement away from said top.

4. The polymeric container according to claim 1, further including:

said upstanding wall including a substantially cylindrical portion;

a plurality of internally protruding diagonal ridges disposed upon said cylindrical portion; and, when the heated fluid and the gas are injected into said container, said base of said container resisting movement away from said top.

5. A method of filling a container, comprising:

(a) providing a polymeric container, including:

a top, a base, and an upstanding wall connected therebetween;

said container having a volume;

said base having:

an annular outer ridge which protrudes away from said top, said outer ridge having a diameter and defining a plane upon which said container may rest;

a dome connected to said outer ridge wherein said dome has a diameter of at least about 25% of the diameter of the outer ridge diameter and is disposed within said outer ridge, said dome protruding away from said top, said dome having an apex which resides between said top and said plane; and, a flexible annular joint connecting said outer ridge and said dome, said annular joint forming an annular inner ridge which protrudes toward said top;

(b) providing a fluid and a gas;

(c) heating said fluid;

(d) injecting said heated fluid and said gas into said container, (e) sealing said top of said container;

(f) allowing said fluid and gas within said container to cool while the dome remains protruding away from the top; and (g) observing that during (f) said dome moves toward said top thereby reducing said volume of said container.

6. The method of claim 5, further including:

in (a), said upstanding wall including a substantially cylindrical portion; and, a plurality of internally protruding diagonal ridges disposed upon said cylindrical portion.

7. The method of claim 5, further including:

in (d), when said heated fluid and said gas are injected into said container, said base of said container resisting movement away from said top.

* * * * *